United States Patent [19]

Ochi

[11] 4,097,047

[45] Jun. 27, 1978

[54] DEVICE FOR KICKING BALL IN A PINBALL GAME MACHINE

[75] Inventor: Shikanosuke Ochi, Hon, Japan

[73] Assignee: Kabushiki Kaisha Sega Enterprises, Tokyo, Japan

[21] Appl. No.: 752,662

[22] Filed: Dec. 20, 1976

[30] Foreign Application Priority Data

Dec. 24, 1975 Japan ..... 50-173651[U]

[51] Int. Cl.[2] ..... A63F 7/00

[52] U.S. Cl. ..... 273/127 R; 273/129 HA; 200/61.11

[58] Field of Search ..... 273/129 D, 129 HA, 127 R, 273/121 A, 121 D, 121 R, 121 E, 119 R, 119 A, 122 R, 122 A, 123 R, 123 A, 124 R, 124 A, 125 R, 125 A, 118 A; 335/220, 281, 297; 200/61.11

[56] References Cited

U.S. PATENT DOCUMENTS

| | | | |
|---|---|---|---|
| 2,235,011 | 3/1941 | Chaney | 200/61.11 X |
| 2,285,244 | 6/1942 | Williams | 200/61.11 |
| 3,180,646 | 4/1965 | Zale et al. | 200/61.11 X |
| 3,472,513 | 10/1969 | Bizouard | 273/127 R |
| 3,785,653 | 1/1974 | Hilliburton | 273/129 D X |
| 3,826,883 | 7/1974 | Foster et al. | 273/129 D X |
| 3,857,567 | 12/1974 | Goldfarb | 200/61.11 X |

*Primary Examiner*—Richard C. Pinkham
*Assistant Examiner*—T. Brown

[57] ABSTRACT

The ball kicking device in a pinball game machine, having a frame detachably mounted on the lower face of a play surface, an electromagnetic coil secured to the frame, an armature disc held on the coil, a bumper head, a pair of upwardly extending poles integrally connecting the disc with the bumper head, and a switch to detect the tilting of the bumper head when a ball abuts thereagainst, thus to energize the coil.

8 Claims, 4 Drawing Figures

DEVICE FOR KICKING BALL IN A PINBALL GAME MACHINE

BACKGROUND OF THE INVENTION

The present invention relates to a device for kicking a ball in a pinball game machine or a Corinthian game machine.

In the prior art pinball game machines, as disclosed in Japanese Patent Publication No. 47416/72, the device for kicking the ball is constructed with an axial center hole therethrough and an electromagnetic coil through which a connecting rod integrally connected to a bumper head passes, and a disc fixedly secured to the lower end of the connecting rod is attracted by the electromagnetic coil when the coil is energized so that the bumper head repels the ball which has abutted against the bumper head.

SUMMARY OF THE INVENTION

The present invention seeks to avoid the disadvantages of the prior art pinball game machine.

The object of the invention is, therefore, to provide an improved ball kicking device in a pinball game machine which avoids the disadvantages of the prior art pinball game machine.

In accordance with the present invention, a compact and durable ball kicking device is provided which is characterized by a frame for the respective bumper head detachably secured to the lower surface of the playing surface, an electromagnetic coil secured to the frame, an armature disc movably located on the electromagnetic coil, pole means integrally connecting the armature disc to the bumper head and a switch adapted to be closed by detecting the tilting of the bumper head upon abutment of the ball against the bumper head so as to apply electric current to the electromagnetic coil thereby causing the ball to be repelled by the dumper head.

As described above, since the ball kicking device of the present invention has the frame for each bumper head detachably mounted on the lower surface of the playing surface, the electromagnetic coil secured to the frame, the armature disc movably located on the electromagnetic coil, pole means with its respective ends integrally connected to the armature disc and the bumper head and the switch for energizing the electromagnetic coil by detecting the tilting of the bumper head, the abutment of the ball against the dumper head causes the tilting of the latter so that the armature head is moved away from the electromagnetic coil thereby causing the switch to be closed to energize the electromagnetic coil and the energization thereof in turn causes prompt attraction of the armature disc by the electromagnetic coil so that the pole means is returned to its upright position, the restoring of the pole means to its upright position resulting in the prompt restoring of the bumper head to its initial position so that the ball is kicked by the bumper head by the impact thereof against the ball caused by the returning movement thereof.

Since the above described action is effected rapidly within a very short time, the striking force of the bumper head against the ball is instantaneous and extremely strong.

In the device of the present invention, since the armature coil is located above the electromagnetic coil instead of being located beneath the electromagnetic coil and being attached to the connecting rod passing through the electromagnetic coil, the attractive force of the electromagnetic coil on the armature disc is made very great thereby resulting in a very strong striking force against the ball.

Further, since the armature disc is located above the electromagnetic coil, the device of the present invention has a very simple construction and is inexpensive and compact and is also very durable.

DETAILED DESCRIPTION OF THE PREFERRED EMBODIMENT

Figure 1:
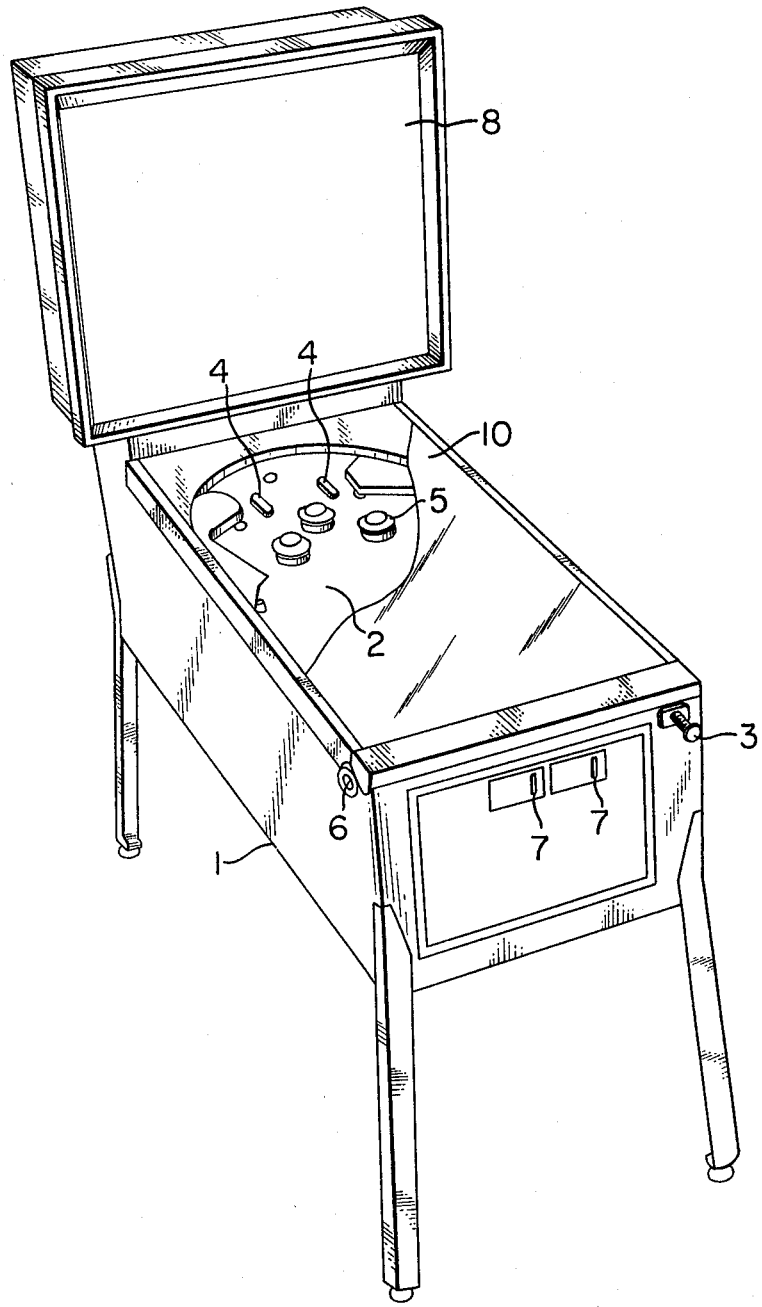
FIG. 1 is a perspective view, showing a pinball game machine incorporating therein an embodiment of the ball kicking device of the present invention.

Referring now to FIG. 1, reference numeral 1 designates the cabinet of the pinball game machine and a playing surface 2 is provided at the upper portion of cabinet 1 in such a position that the playing surface 2 is inclined downwardly in the direction toward the position at which the player is located.

Ball projecting means 3, flipper means (not shown), ball contact detecting means (not shown), projection 4 and bumper heads 5 are arranged in positions on the playing surface 2 in a manner well known in the art.

Flipper buttons 6 are provided at the left and right sides of cabinet 1 at the end where the player is located. Flipper buttons 6 are coupled with the flippers so that the respective flipper is moved so as to drive the ball when the corresponding flipper button 6 is pushed.

Coin receiving slots 7 are provided in cabinet 1 at the side facing the position of the player. When a predetermined amount of coins are inserted through coin slots 7, the pinball game machine is actuated for a given time period.

A score indicating board 8 is provided on cabinet 1 at the end remote from the position of the player. When ball projecting means 3 is actuated so as to strike ball 9 during the operation of the pinball game machine, scores are summed up each time ball 9 contacts with a ball contact detecting means and the total score is indicated on the score indicating board 8.

Front glass plate 10 is located at the top of cabinet 1 above the playing surface 2.

Figure 2:
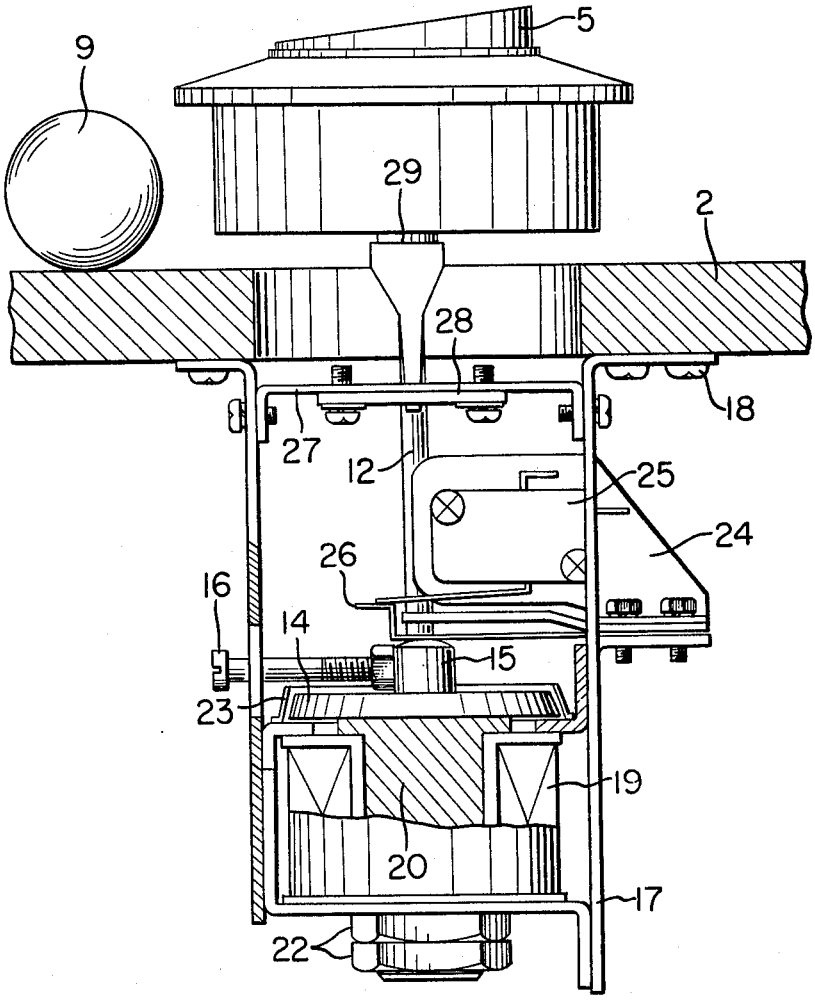
FIG. 2 is a fragmentary sectional side view, showing the main portion of the ball kicking device of the present invention.
Figure 3:
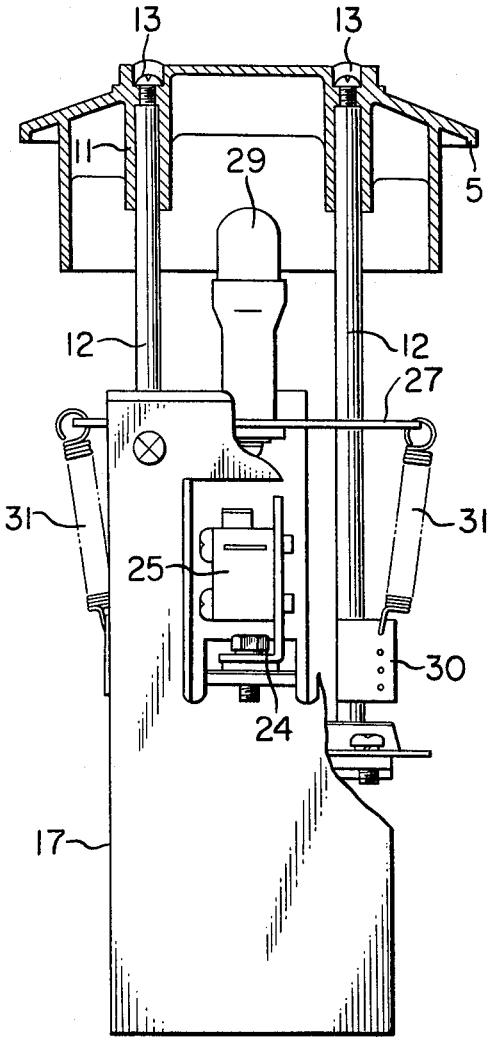
FIG. 3 is a sectional front view, showing portions of FIG. 2.
Figure 4:
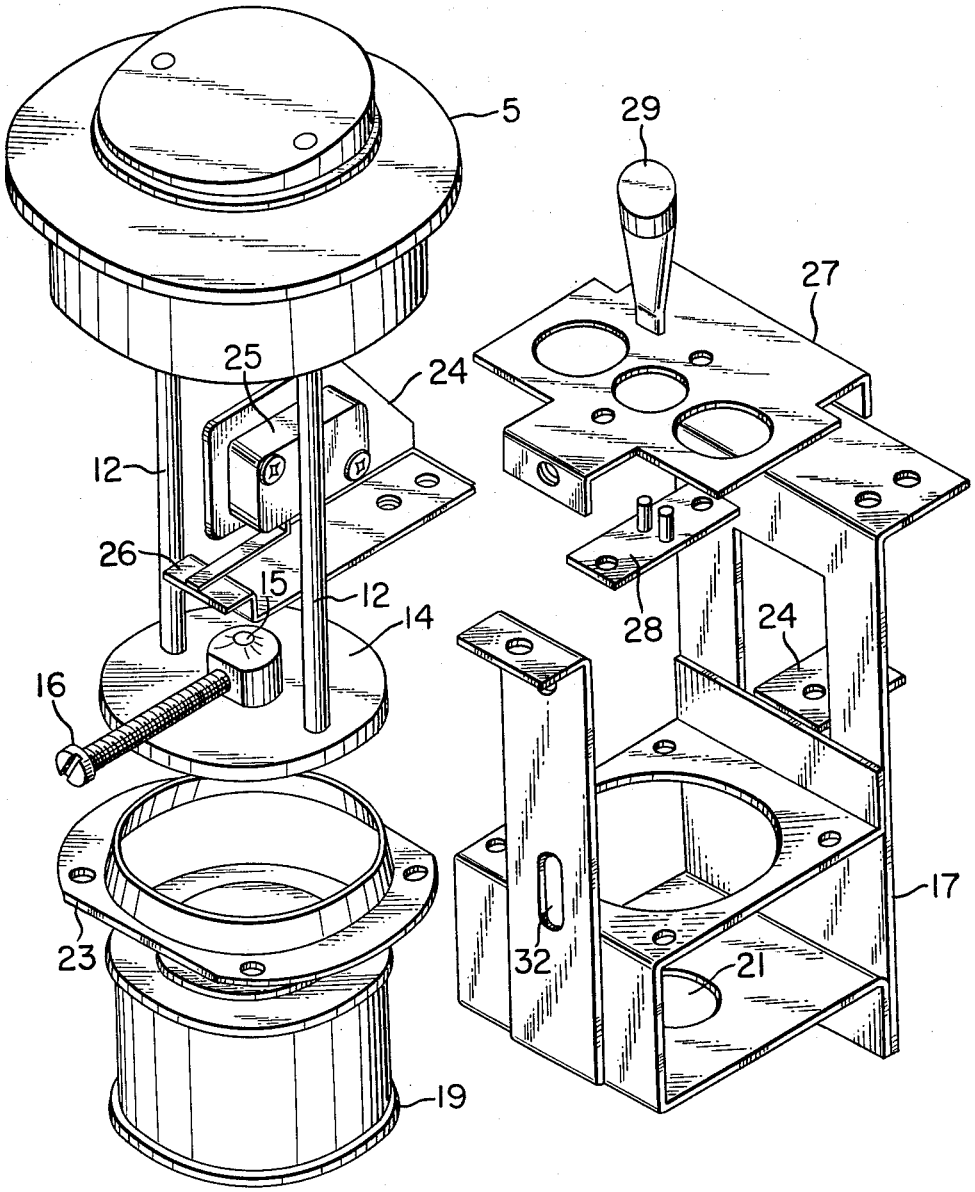
FIG. 4 is an exploded perspective view of the embodiment of the present invention.

As shown in FIGS. 2–4, bumper head 5 is fixedly secured to the upper ends of a pair of poles 12 by supporting portions 11 on bumper head 5 by means of screws 13. An armature disc 14 of magnetic material is integrally secured to the lower ends of poles 12 and a projection 15 is formed at the center of the upper surface of armature disc 14. A screw 16 is threadedly engaged with projection 15.

A frame 17 is secured by screws 18 to the lower surface of playing surface 2 at positions where each of bumper heads 5 is to be located on the playing surface 2. An electromagnetic coil 19 is supported at the lower end of each frame 17 and a ferromagnetic core 20 is fitted in the center hole formed in coil 19. The lower end of core 20 protrudes through a hole 21 in frame 17 and has nuts 22 threaded thereon so as to detachably secure coil 19 and core 20 to frame 17.

Armature disc 14 is located above the upper surface of core 20 in electromagnetic coil 19 and an armature holder 23 is secured to frame 17. Armature holder 23 is positioned above the armature disc 14 with a clearance being left therebetween so that armature disc 14 can be tilted to some degree but cannot be removed from the position above core 20.

A switch supporting bracket 24 is provided at the middle of the height of frame 17 and a limit switch 25 is mounted on bracket 24. A leaf spring 26 is secured to frame 17 and extends between projection 15 on the armature disc 14 and the actuator of limit switch 25. The relative positions of the armature disc 14, leaf spring 26 and the actuator of limit switch 25 are such that limit switch 25 is held open when armature disc 14 is held in contact with the upper surface of core 20 but when armature disc 14 is tilted, projection 15 urges leaf spring 26 upwardly so that it actuates the actuator of limit switch 25 so as to close the same.

A lamp supporting bracket 27 is secured to frame 17 at the upper portion thereof and a lamp holder 28 is attached to the lower surface of bracket 27. Lamp holder 28 supports a lamp 29 at a position centrally of the space in bumper head 5.

As shown in FIG. 3, a spring holder 30 is secured to the lower portion each of the poles 12 and tension springs 31 are secured at their one ends to the respective spring holders 30 while the other ends are secured to lamp supporting bracket 27. The force of tension springs 31 is such that the weight of the assembly of the bumper head 5, poles 12 and armature disc 14 is counterbalanced but armature disc 14 is snugly held in contact with core 20.

As shown in FIG. 4, a vertically elongated hole 32 is provided in frame 17 and screw 16 secured to projection 15 on armature disc 14 is slidably received in elongated hole 32 so that bumper head 5 is held at a determined angular position about the vertical axis.

Limit switch 25 is connected in an electric circuit connecting electromagnetic coil 19 to a power source so that, when limit switch 25 is closed, electromagnetic coil 19 is energized.

In the operation of the embodiment constructed as described above, armature disc 14 is held in close contact with core 20 as long as a ball 9 does not abut against bumper head 5, so that poles 12 are held in upstanding positions and limit switch 25 is held opened so as to keep electromagnetic coil 19 in a deenergized condition.

Under such conditions, when a ball 9 rolling on the playing surface against 2 abuts against bumper head 5 so as to move the same in the direction in which ball 9 is moving thereby tilting poles 12, armature disc 14 is also tilted to move projection 15 upwardly so that leaf spring 26 actuates the actuator of limit switch 25 to close the same. Thus, electromagnetic coil 19 is energized to attract armature disc 14 which has been tilted thereby moving armature disc 14 into contact with core 20. Thus, poles 12 are restored in their initial upstanding positions and bumper head 5 is rapidly moved to its initial position so that the ball 9 is repelled by bumper head 5 so as to move in a direction opposite to that in which ball 9 has been moving.

Since the above described action is effected in a very short time period, the impact force of bumper head 5 against ball 9 is very great so that ball 9 is forcibly repelled by bumper head 5.

Further, since the pair of poles 12 has a space between the poles, lamp 29 can be positioned at the center of the space within bumper head 5 thereby permitting bumper head 5 to be illuminated uniformly.

Further, since armature disc 14 is merely held above core 20 and the lateral movement thereof is limited by armature holder 23, the construction of the device of the present invention is extremely simple and compact and it has good durability.

Since no holes are provided through core 20 and armature disc 14, the contact area of both is large so that the attractive force of electromagnetic coil 19 is very great.

Interchange of lamp 29 is easily effected, because bumper head 5 can be easily detached by loosening screws 13.

I claim:

1. A device for kicking a ball in a pinball game machine having a playing surface on which the ball is adapted to be rollingly moved and bumper heads adapted to repel the ball when the same abuts thereagainst, wherein the improvement comprises a frame detachably mounted on the lower surface of said playing surface in position beneath each said bumper head, an electromagnetic coil secured to said frame and spaced below said playing surface, an armature disc movably held on said electromagnetic coil between said electromagnetic coil and said playing surface, pole means rigidly connecting said armature disc to the respective bumper head and a switch connected to said electromagnetic coil to detect the tilting of said bumper head upon abutment thereof by said ball so as to be closed for energizing said electromagnetic coil which causes said armature disc to be attracted to said electromagnetic coil and rapidly return said bumper head to a normal position to repel said ball.

2. A device according to claim 1, wherein said switch is positioned between said playing surface and said armature disc.

3. A device according to claim 2, wherein said bumper head, said armature disc and said pole means are rigidly connected together and are suspended by spring means attached to said frame such that said armature disc is held in light contact with said electromagnetic coil so that the tilting of said bumper head is facilitated by the force of said spring means acting against gravitational force acting on said bumper head, said armature disc and said pole means.

4. Device according to claim 3, wherein said electromagnetic coil is provided with a ferromagnetic core located centrally of said electromagnetic coil so as to enhance magnetic force thereof acting on said armature disc.

5. Device according to claim 2, further comprising an upwardly extending projection integrally formed at the center of said armature disc and a leaf spring interposed between said projection and said switch so that said switch is actuated by said projection through said leaf spring when said armature disc is tilted upon abutment of said ball against said ball bumper head.

6. Device according to claim 5, further comprising a rod integral with said projection and a vertical elongated hole formed in said frame, said rod being slidably received through said vertical elongated hole so that the rotation of said armature disc about the vertical of said projection axis is prevented during tilting of said armature disc.

7. Device according to claim 1, wherein said pole means comprises two parallel spaced apart poles having a lamp positioned therebetween so as to permit said bumper head to be uniformaly illuminated by said lamp.

8. Device according to claim 1, wherein an armature holder is provided around said armature disc with a clearance held therebetween so that tilting of said armature disc relative to said electromagnetic coil is permitted while removal of said armature disc from said electromagnetic coil is prevented.

* * * * *